US005511489A

United States Patent [19]

Bullock

[11] Patent Number: 5,511,489

[45] Date of Patent: Apr. 30, 1996

[54] DUAL FACE FRICTION WEDGE

[75] Inventor: Robert L. Bullock, Antioch, Ill.

[73] Assignee: Standard Car Truck Company, Park Ridge, Ill.

[21] Appl. No.: 243,827

[22] Filed: May 17, 1994

[51] Int. Cl.[6] ..... B61F 5/06

[52] U.S. Cl. ..... 105/198.2; 105/198.4

[58] Field of Search ..... 105/198.2, 198.4, 105/198.5

[56] References Cited

U.S. PATENT DOCUMENTS

| | | | |
|---|---|---|---|
| 2,458,210 | 1/1949 | Schlegel, Jr. | 105/198.2 |
| 2,481,475 | 9/1949 | Lehrman | 105/198.2 |
| 2,572,634 | 10/1951 | Lehrman | 105/198.2 |
| 2,749,113 | 6/1956 | Kowalik | 105/198.5 X |
| 3,026,819 | 3/1962 | Cope | 105/198.2 |
| 3,714,905 | 2/1973 | Barber | 105/198.4 |
| 4,244,298 | 1/1981 | Hawthorne et al. | 105/198.4 |
| 4,426,934 | 1/1984 | Geyer | 105/198.4 |
| 4,986,192 | 1/1991 | Wiebe | 105/198.4 |
| 5,086,708 | 2/1992 | McKeown, Jr. et al. | 105/198.2 X |
| 5,095,823 | 3/1992 | McKeown, Jr. | 105/198.2 |

*Primary Examiner*—Robert J. Oberleitner
*Assistant Examiner*—Kevin D. Rutherford
*Attorney, Agent, or Firm*—Dorn, McEachran, Jambor & Keating

[57] ABSTRACT

A friction wedge for use in damping relative movement between the bolster and the side frame of a railroad car truck includes a body formed and adapted to be positioned in a pocket of one of the bolster and side frame. The body has spaced body portions integrally joined by an intermediate connecting portion. Each of the spaced body portions has a friction surface formed and adapted during normal use to be in frictional contact with a wear resistant surface on the other of the bolster and side frame. The spaced friction surfaces on the wedge body are effective to increase the resistance to bolster/side frame warp movement over and above the resistance provided by a continuous friction surface which is equal in width to the distance between the outside of each of the spaced friction surfaces.

10 Claims, 5 Drawing Sheets

Fig.1.
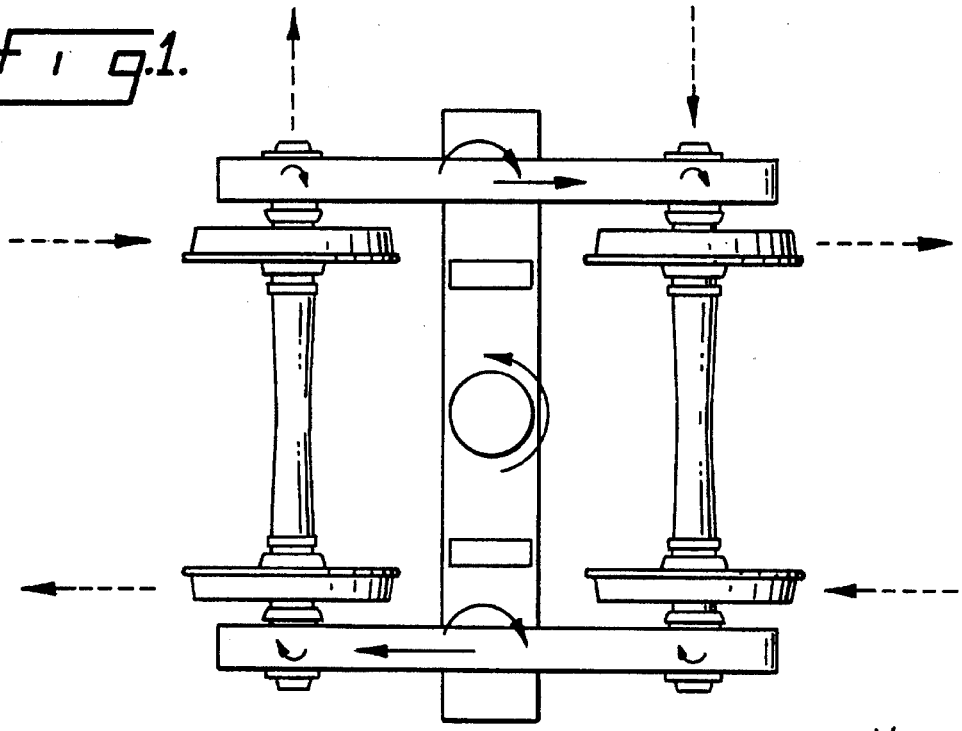
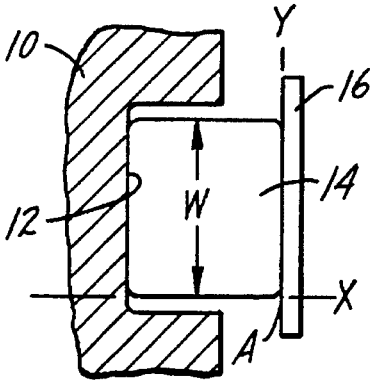
Fig.2.
(PRIOR ART)
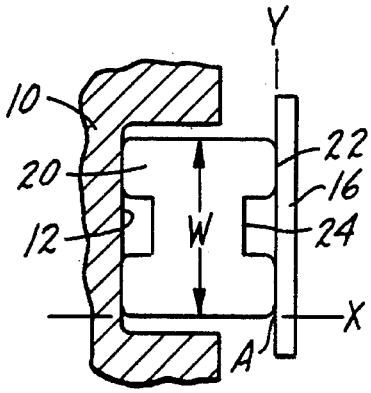
Fig.4.
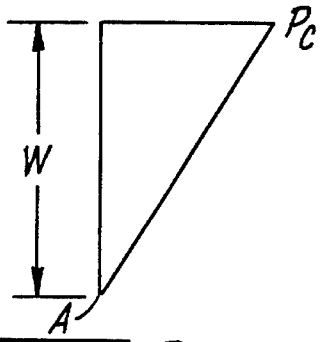
Fig.3.
(PRIOR ART)
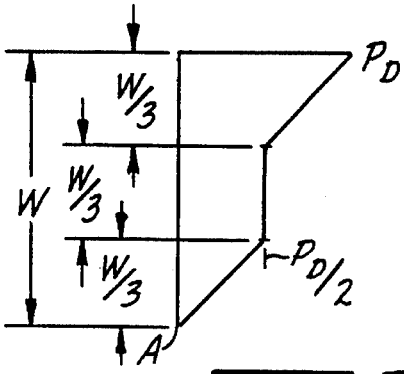
Fig.5.

Fig. 6.
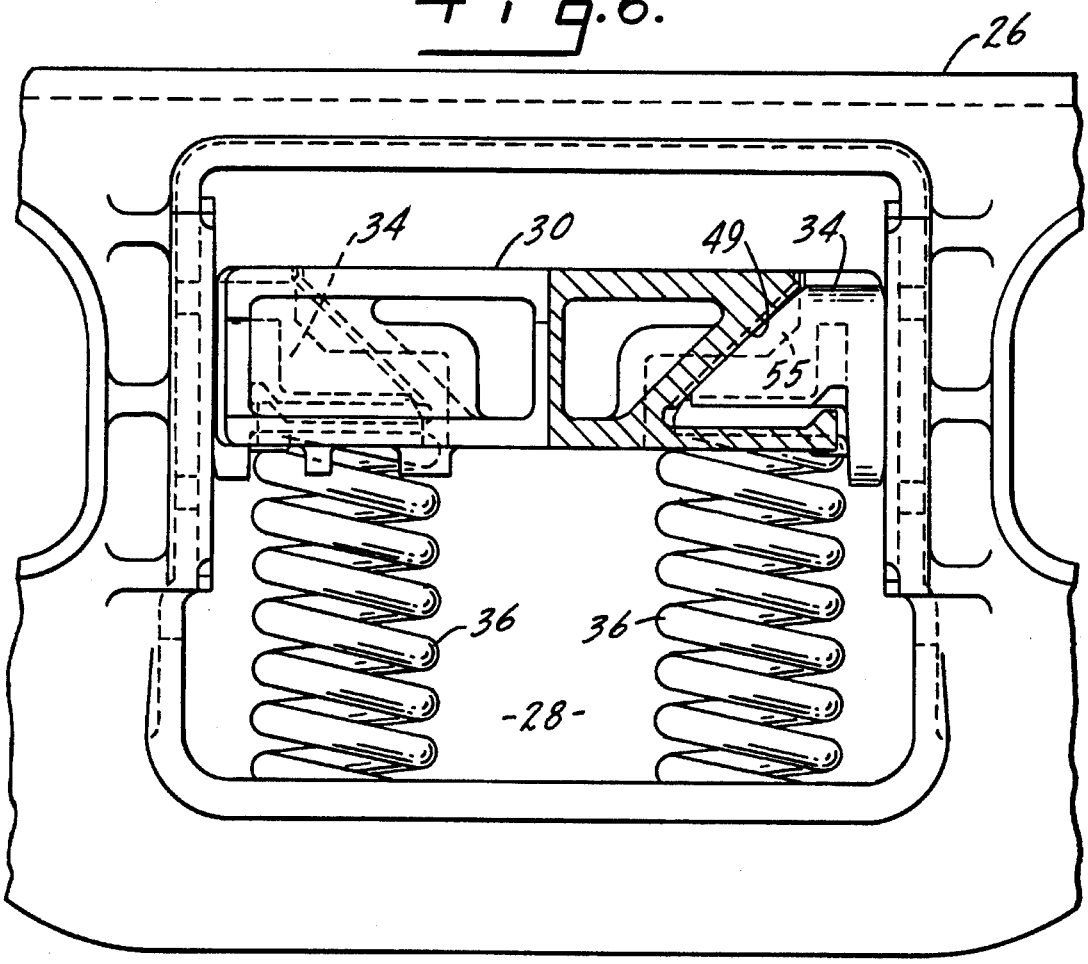
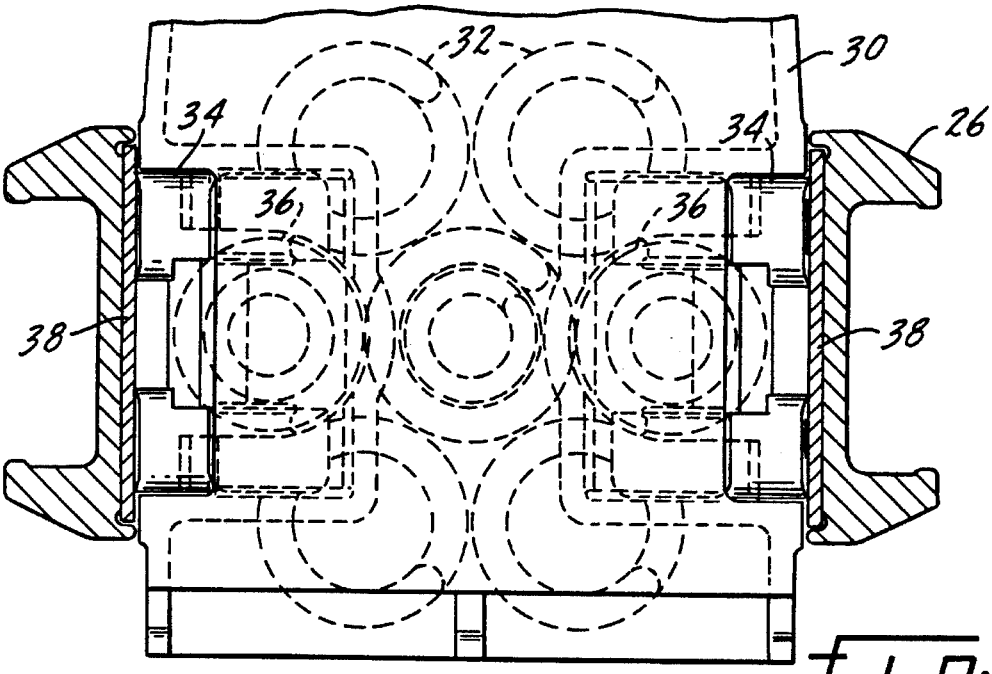
Fig. 7.

DUAL FACE FRICTION WEDGE

THE FIELD OF THE INVENTION

The warp restraint of a railroad freight car truck is the ability of the truck to resist the unsquaring forces imposed upon it during curving. The unsquaring moments are caused by high rotational resistance between the truck and car body and the loss of forward longitudinal creep forces between the wheel and rail. Increasing friction between the truck and car body at the center plate and constant contact side bearings increases the unsquaring moments imposed upon the truck while decreasing friction due to wheel/rail lubrication decreases the longitudinal creep force which tends to steer the truck through curves thus requiring higher warp restraint within the truck itself. The general trend is to use constant contact side bearings for high speed hunting stability and lubrication of the outside wheel and/or rail in curves to reduce wheel flange and rail wear. Both of these trends require warp restraint to be further increased in freight car trucks. When a truck is curved properly it remains square and the leading wheelset can steer through the curve with an acceptable angle of attack and an acceptable lateral to vertical (L/V) force ratio between the wheel and the rail. When acceptable angle of attack and L/V force ratio are exceeded derailments are likely. However, when the truck's warp restraint is overwhelmed by high rotational resistance and loss of longitudinal creep force due to outside wheel/rail lubrication, the truck frame squareness collapses causing the outside wheel on the leading wheelset to trail the inside wheel resulting in unacceptable angle of attack and L/V force ratio between the wheel and the rail. The 125 ton freight car truck used under the double stack intermodal car with its four constant contact side bearing arrangement provides the greatest challenge for a freight car truck to resist collapsing squareness.

One solution to the steering problems imposed by railroad track curves is the so-called radial truck in which the longitudinal restraints on the wheelset are sufficiently low and the lateral restraint between the wheelsets are sufficiently high that the wheelsets can assume a radial configuration relative to track curvature. However, because of the primary suspension the required high lateral restraint between wheelsets of the radial truck design require the wheelsets to be interconnected for high speed hunting stability and brake application. This complication of the interconnection causes high initial cost, and for this reason, the radial trucks have not found favor with the railroads. The current practice in the industry is to increase the warp restraint of a truck so that it maintains an essentially square configuration as it passes through curves. The warp restraint is made up of the sum warp stiffness and warp friction resistance within the truck assembly itself. Increasing the warp restraint provides the most practical solution for freight car truck design. It is well known that a rigid solid frame truck is not a good solution for a freight car truck in North America, but the ideal solution consistent with the economics of the railroad freight industry is to maintain the resistance to warp as high as possible while permitting the proper degree of warp movement within the truck frame for excellent high speed stability.

The prior art illustrates several attempts at increasing warp stiffness. U.S. Pat. No. 3,714,905, owned by the assignee of the present application, and U.S. Pat. Nos. 4,244,298, and 2,458,210, all disclose the concept of splitting the friction wedge which dampens relative movement between the bolster and the side frame. By splitting the friction wedge into two independent wedges, each with its own spring, there is greater warp resistance, but this configuration may create more problems than it solves. Specifically, the use of two separate friction wedges on each side of each end of the bolster, each with its own spring, provides a damping system in which it is at least as likely that the bolster and side frame will assume a permanent out-of-square position as it will a permanent square position. Since each friction wedge has its own spring, one or more of the wedges may be locked up in a particular position in its pocket and there may not be sufficient force to release the wedge, resulting in an out-of-square position. This can happen either at initial installation or in service due to an irregularity in the track. Once such an out-of-square position has been assumed, it will be exaggerated every time an imperfection in the track is encountered by the truck, with eventually the squareness of the truck reaching truck collapse.

When a truck collapses, tests have shown that the degree of warp is so high that for an instant of time, usually only a fraction of a second, the brake beam may actually strike the wheel flange, causing the wheel to instantaneously slide on the track rather than roll. This sliding causes a hot spot on the wheel resulting in what is termed "spalling" or "shelling." An essentially martensite metallurgical condition is formed at the hot spot which may lead to a breakage of a portion of the wheel tread surface or a crack in the wheel. Spalling or shelling is one of the primary reasons why wheels are replaced in freight car trucks. The end result of excessive warp between the bolster and the side frame of a freight car truck is damage to the truck, possible damage to the wheels, and ultimately derailment.

Truck warp restraint, or the ability of the truck to resist out-of-square forces, is made up of the journal warp friction and the suspension warp friction moment and stiffness. The journal warp friction moment is the frictional resistance to pivotal movement between the axle of the wheel and the side frame where the side frame sits upon the axle journal bearing. Suspension warp friction moment is the frictional resistance to warping brought about by the damping system which is effective between the bolster and the side frame. The suspension warp stiffness is the stiffness resistance to warping brought about by the springs in the suspension system that supports the bolster within the side frame window opening. Journal warp friction moment is made up of the weight per journal and a pedestal constant. Since the weight per journal is determined by the weight of the car, this is not an area which lends itself to improvement in warp resistance. Suspension warp resistance, or suspension warp friction moment, is equal to a suspension constant times the width of the friction wedge times the column force in pounds divided by the truck wheelbase. The truck wheelbase is fixed for a given car. Although it is possible to increase the column force by increasing the force provided by the springs supporting the friction wedges, there is an upper limit in which the column force becomes so high that the truck effectively locks up, eliminating any suspension isolation effect of side frame bolster relative movement. Clearly, the area which lends itself to increasing warp resistance is the width of the friction wedge.

The present invention provides the advantage of the dual friction wedge concept without its inherent disadvantage of two friction wedges supported by one or two springs. In the present invention there is a single friction wedge supported by a single coaxial spring assembly, but with the friction wedge having two spaced friction surfaces which are in load contact with a side frame wear surface. The invention will be described in connection with a freight car truck in which the wedge is located in a bolster pocket and bears against a wear surface on the column of the side frame. The invention is equally applicable in a truck design in which the pocket is in the side frame and the wear surface is on the bolster.

The present invention utilizes a friction wedge having a conventional width, and the width will depend upon the truck design and the type of freight car which the truck will support. The wedge of convention width is formed so that it has two spaced friction surfaces instead of a continuous friction surface across its width. The effect of providing a recess in a central location of the wedge friction surface is to redistribute the force resisting pivotal movement between the bolster and the side frame. In a conventional wedge which is continuous across its friction surface, the distribution of load across the face is linear. By removing an intermediate or center portion of the friction surface, the center portion of the load is redistributed, a portion of the load being applied at a location further from the axis of rotation between the bolster and the side frame and a portion being applied at a point closer to the axis of rotation. The net result is an increase in the resistance to turning movement over that which would be provided if the friction surface was continuous across its width.

SUMMARY OF THE INVENTION

The present invention relates to freight car trucks and in particular to a suspension system which increases warp restraint in a conventional three-piece truck.

Another purpose of the invention is a freight car truck having increased warp restraint by virtue of increasing the effective width of the friction wedge which provides damping to relative movement between the bolster and side frame.

Another purpose of the invention is increased warp restraint in a conventional three-piece truck without affecting vertical or lateral suspension characteristics between bolster and side frame.

Another purpose of the invention is to provide a friction wedge for the use described which has an increase in its effective width by virtue of shifting a portion of the warp restraint applied by the wedge away from the point of rotation between the bolster and side frame.

Another purpose of the invention is to provide a friction wedge having spaced friction surfaces supported by a single coaxial wedge spring assembly.

Another purpose of the invention is to provide a friction wedge having split or spaced friction surfaces, but without the disadvantage of the prior art split wedges, each of which was supported directly by springs.

Another purpose is a friction wedge as described including provision for protecting the wall of the bolster pocket.

Other purposes will appear in the ensuing specification, drawings and claims.

BRIEF DESCRIPTION OF THE DRAWINGS

The invention is illustrated diagrammatically in the following drawings wherein:

FIG. 1 is a diagrammatic illustration of a freight car truck showing the forces applied thereto during normal operation;

FIG. 2 is a diagrammatic illustration of the relationship between the bolster pocket, friction wedge, and side frame column wear plate in a conventional three-piece truck;

FIG. 3 is a force diagram illustrating the force distribution caused by turning movement between the bolster and the side frame in the conventional truck illustrated in FIG. 2;

FIG. 4 is a diagrammatic illustration of the friction wedge of the present invention positioned in the bolster pocket and against the side frame column wear plate, as is the conventional truck of FIG. 2;

FIG. 5 is a force diagram, similar to FIG. 3, but showing the forces applied to the wedge face of the friction wedge illustrating in FIG. 4;

FIG. 6 is a side view, in part section, of a portion of a railroad car truck;

FIG. 7 is a top view of the bolster/side frame construction of FIG. 6;

DESCRIPTION OF THE PREFERRED EMBODIMENT

Figure 8:
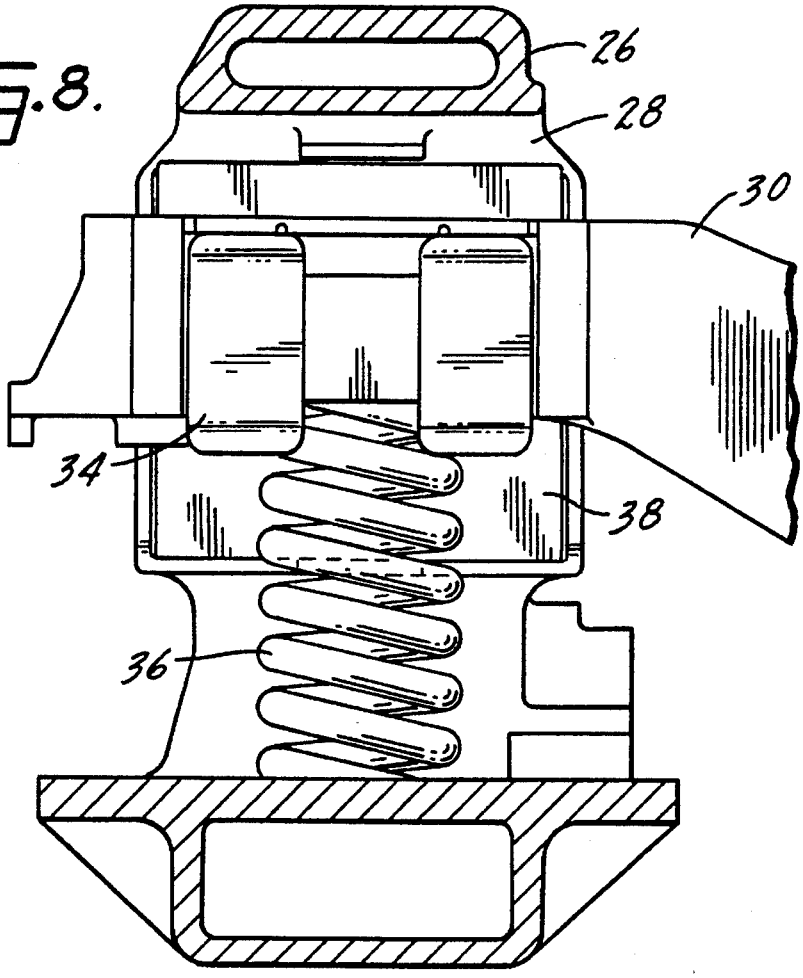
FIG. 8 is a vertical section of the bolster/side frame construction of FIG. 6.
Figure 9:
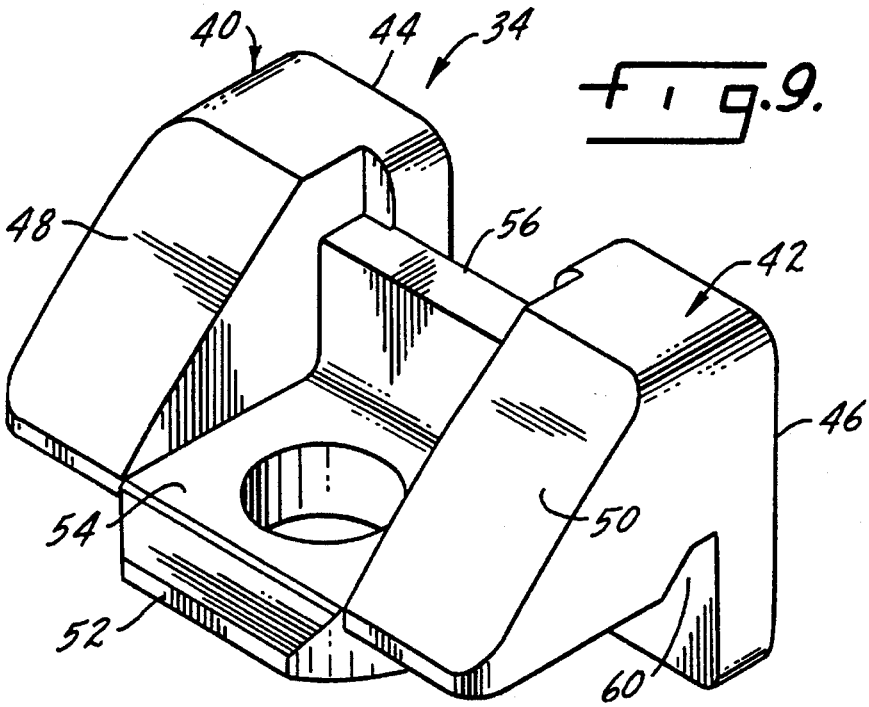
FIG. 9 is a perspective view of the friction wedge of the present invention.
Figure 10:
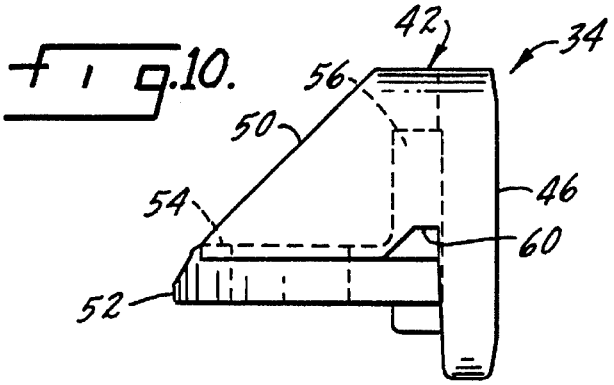
FIG. 10 is a side view of the friction wedge.
Figure 11:
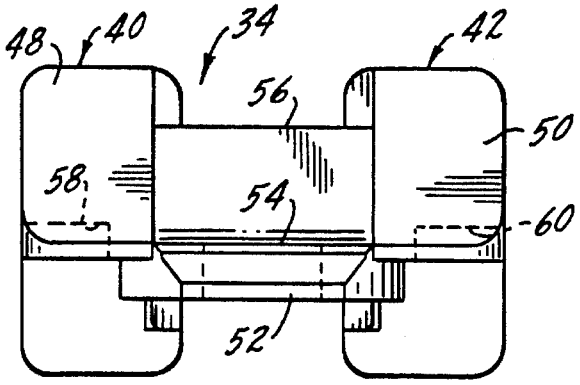
FIG. 11 is a left side view of the friction wedge of FIG. 10.
Figure 12:
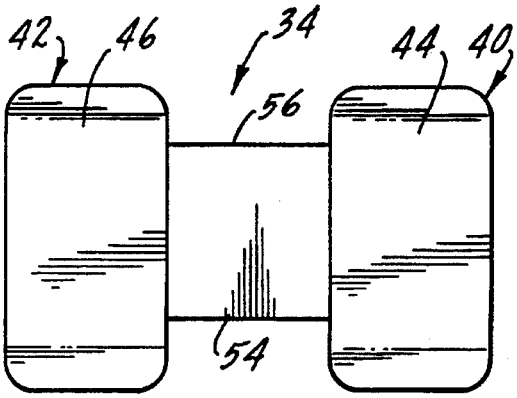
FIG. 12 is a right side view of the friction wedge of FIG. 10.
Figure 13:
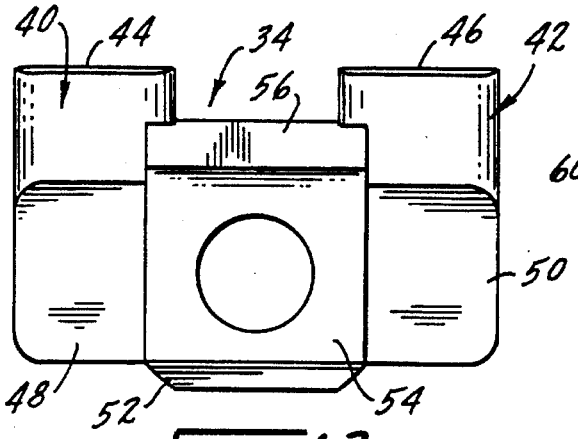
FIG. 13 is a top view of the friction wedge.
Figure 14:
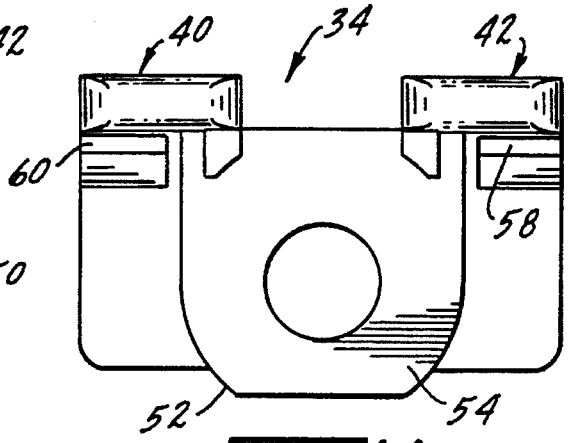
FIG. 14 is a bottom view of the friction wedge.

FIG. 1 illustrates the steering and warp moments in a three-piece freight car truck. The steering movement is due to the longitudinal creep forces applied in opposite direction to the wheels as the truck negotiates a curve. The warp moments applied to the truck as it negotiates a curve are illustrated by the arrows showing lateral forces in opposite direction applied to the wheelsets due to the contact between the wheels and the rails. The warp moment causes relative rotation between the bolster and the side frames, with the warp moment and the steering moment together equaling the turning moment which is the rotational force applied to turn the truck where the car body is supported on it. This turning moment is resisted by the constant contact side bearings which restrain turning movement of the truck relative to the car body.

Truck warp restraint, which is the ability of the truck to resist out of square forces created by truck and car body frictional resistant contact is made up of the journal warp friction and the suspension warp friction moment. The journal warp friction moment is the frictional resistance to pivotal movement between the axle of the wheel and the side frame where the side frame sits upon the axle journal bearing. Suspension warp restraint is the resistance to warping brought about by the suspension and damping system which is effective between the bolster and the side frame. Journal warp friction moment is made up of the weight per journal and a pedestal constant. Since the weight per journal is determined by the weight of the car, this is not an area susceptible to an improvement in warp resistance moment. Suspension warp restraint is equal to a suspension constant times the width of the friction wedge times the column force in pounds divided by the truck wheelbase. The truck wheelbase is fixed for a given car. Although column force can be increased by increasing the force provided by the springs supporting the friction wedge, there is an upper limit where the column force is so high that the truck will lock up and effectively have no suspension properties at all. The clear area for increasing warp resistance is the width of the friction wedge.

In FIG. 2 the bolster is indicated at 10 and the bolster pocket is indicated at 12. A conventional friction wedge 14 having a width W is positioned in the pocket 12 and is shown to be bearing against a side frame column wear plate 16. Point A, the intersection of the X and Y axes, representative of the desired square position of the bolster and the side frame is the point where relative rotation between these elements is created due to the lateral forces applied by wheel/rail contact. There will be an outboard point A and an inboard point A at each side of the bolster as the lateral forces applied to the wheelsets will tend to move the side frames concurrently about the bolster which is located generally at the center of the side frames.

The force diagram of FIG. 3 illustrates the distribution of the load applied by the conventional friction wedge 14 on the side frame column wear plate 16 by the turning movement about point A due to the lateral and rotational forces applied to the truck during curving. The maximum moment about point A is equal to 0.33 $W^2P_c$ where W is the width of the casting and $P_c$ is the load distribution across the width of the friction wedge.

FIG. 4 diagrammatically illustrates the friction wedge of the present invention. The wedge 20 positioned within the bolster pocket 12 has the same width W as the wedge illustrated in FIG. 2. The face 22 of the wedge 20 which is in contact with the side frame column wear plate 16 has a recess or space 24 generally in the center. The width of the recess 24 is generally equal to the width of the adjacent portions of the surface 22 which contact the wear plate 16. In effect, the surface 22 of the wedge has been divided into thirds, with the outer and inner thirds being in contact with the wear plate 16 and the center third being out of contact.

FIG. 5 illustrates the force distribution of the friction wedge of FIG. 4 in the same manner as FIG. 3 illustrated the force distribution of the wedge in FIG. 2. $P_D$ is equal to the load distribution over two thirds of W, which is the width of the friction wedge actually in contact with the wear plate. Since the total force applied by the friction wedge of FIG. 2 and by the friction wedge of FIG. 4 is the same, a summation of the warp moments about point A for the wedge of FIG. 4, as illustrated by the force diagram of FIG. 5, shows that the moment is 0.402 $W^2P_c$ where $P_c$ was the load distribution across the width of the friction wedge in FIG. 2. This provides an increase in the moment about point A or the resistance to unsquaring forces applied to the truck of approximately 20 percent. The actual increase in the resistance to warp movement will be determined by the actual area of the recess 24 and thus the size or width of the areas of contact between the friction wedge and the wear plate. The end result of providing the recess 24 in the friction wedge of the casting 20 is to provide an effective increase in the width of the friction wedge because a portion of the load which had been applied in the center of the friction surface has now been moved away from the point of rotation, increasing the moment arm and thus increasing the resistance to warp movement. The invention should not be limited to a wedge in which the friction surface is divided into thirds. Theoretically, the larger the recess, the greater the resistance to warp movement. Practically, if the spaced areas of frictional contact are small, the higher the unit pressure on the wedge which leads to increased wear and possible disintegration.

A conventional three-piece truck with a bolster pocket and the friction wedge of the present invention is illustrated in FIGS. 6, 7, 8, 15, 16 and 17. The side frame is indicated at 26 and has a window 28 within which is positioned a bolster 30. The bolster is supported by load springs 32, as is conventional. The wedge is illustrated at 34 and is supported by a damping spring 36. The side frame has a column wear plate 38 which provides a wear surface for the friction wedge, as is conventional.

Figure 15:
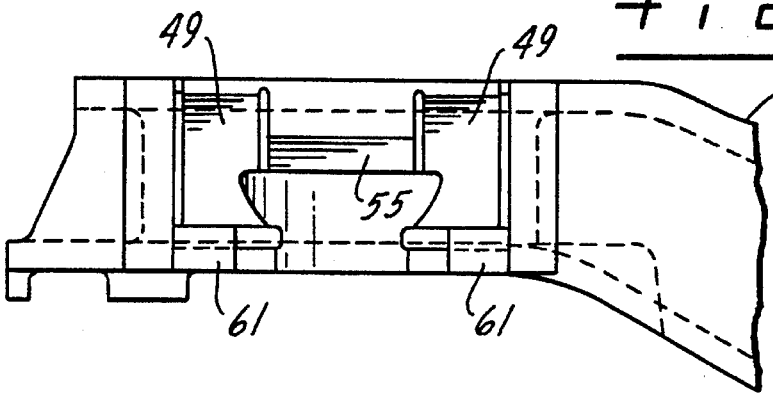
FIG. 15 is a partial side view of the bolster illustrating the bolster pocket.

The friction wedge 34 is illustrated in detail in FIGS. 9 through 17. The wedge includes a single body having laterally spaced body portions 40 and 42, with each body portion having a friction surface 44 and 46, respectively. The body portions 40 and 42 may have generally the configuration of a conventional friction wedge in that there is the planar surface 44 for contact with the side frame column wear plate and the conventional slanted rear surfaces 48 and 50 for contact with the slanted wall portions 49 of the bolster pocket 51 (FIG. 15). The body portions 40 and 42 are interconnected by a central section or portion 52 which has a shelf 54 and an upstanding intermediate wall 56. The entire casting is a single integral unit which has the effect of providing two spaced friction surfaces joined together in a single element. The underneath side of the shelf 54 provides a seat for the wedge spring 36.

The space between the body portions 40 and 42 provides an area for a wedge retainer 55 extending outwardly from between the bolster pocket slanted wall portions 49. One of the problems in the use of friction wedges of the type in the prior art is the substantial wear applied by the outboard side of the friction wedge on its adjacent bolster pocket wall. A proposed solution to this problem is illustrated in U.S. Pat. No. 4,426,934 which discloses what is characterized as a wraparound plate to protect the inside of the bolster pocket. Such has not proven economically advantageous for the railroads. However, with the present wedge design it is possible to weld or cast a retainer integral with the bolster pocket, which retainer will extend within the space between the body portions 40 and 42, thus restraining the friction wedge from contacting the outboard bolster pocket wall and damaging it.

Each of the body portions 40 and 42 have downwardly-facing tapered grooves 58 and 60. The grooves 58 and 60 cooperate with a nub 61 on the bolster pocket so that the friction wedge can be loosely held within the pocket as the truck is assembled.

Figure 16:
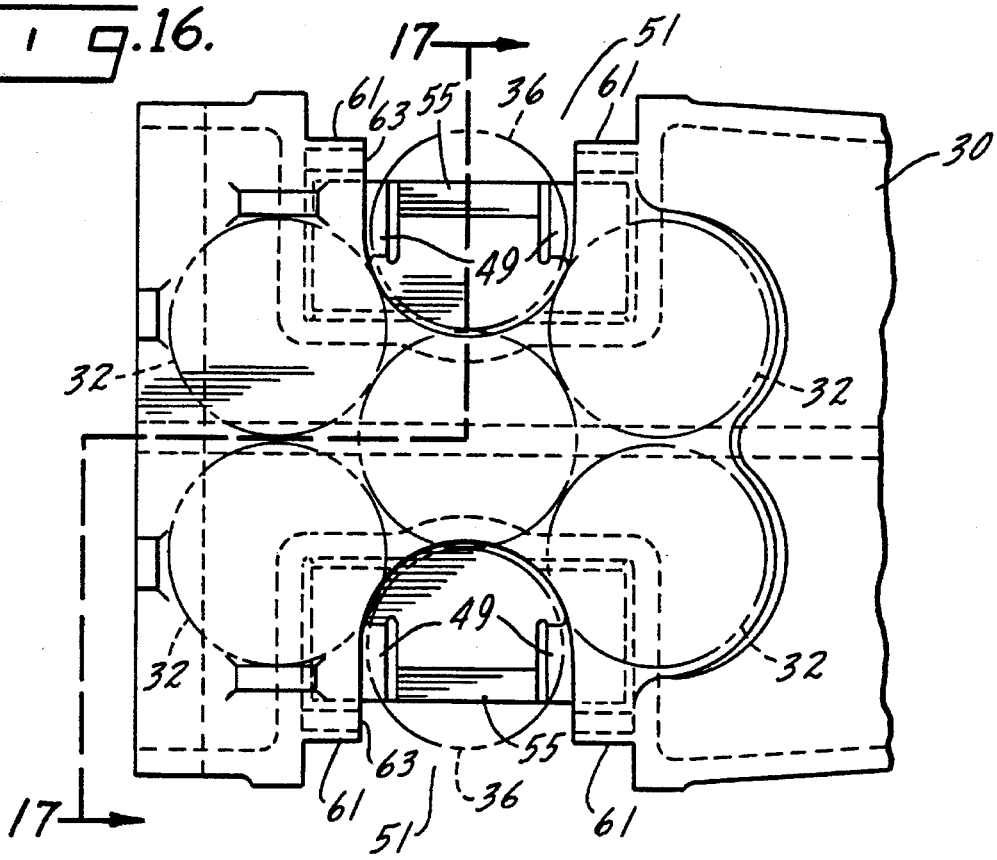
FIG. 16 is a bottom plan view of the bolster with the support spring shown in phantom lines.
Figure 17:
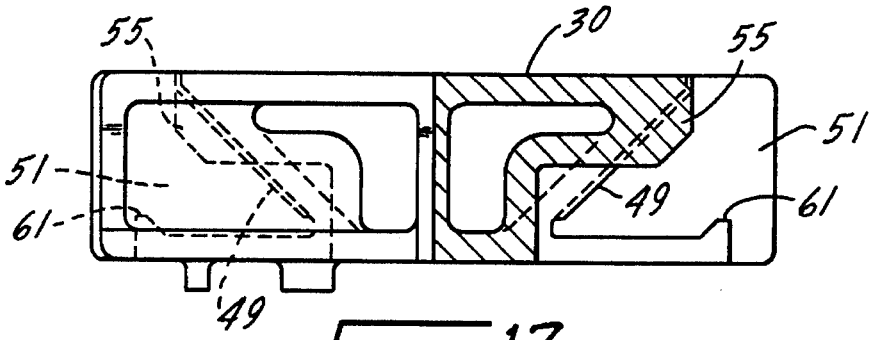
FIG. 17 is a section along planes 17—17 of FIG. 16.

In a conventional three-piece truck the wedge is inserted from the bottom and then its support spring is placed beneath it. In the present design that is not possible since the shelf 54, which provides the seat for the damping spring 36, overlaps at least in part the area of the bolster bottom surrounding the opening 63 through which the damping spring 36 passes to the underside of the wedge. This is shown in FIGS. 7 and 16. For this reason it is impossible to locate the wedge within the bolster pocket after the bolster and side frame have been assembled. Accordingly, in the present construction it is necessary to place the wedge in the bolster pocket before the bolster is placed within the side frame window.

The present invention provides the advantages of the so-called split wedge, as for example illustrated in U.S. Pat. No. 3,714,905. It does so without the inherent disadvantages of that damping system, specifically the use of a separate spring to support each wedge element. The result of providing a generally centrally located recess in the face of the friction wedge facing the column wear plate is to increase the effective width of the wedge, thus increasing warp restraint while maintaining all of the elements of the three-piece truck within the dimensional requirements specified by the A.A.R.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad car truck including a pair of side frames and a bolster extending therebetween, a friction wedge for use in damping relative movement between the bolster and one of said side frames, a pocket in facing portions of one of the bolster and side frame, said wedge including a body formed and adapted to be positioned in the pocket, said body having an area of contact formed thereon by a pair of spaced, planar, generally parallel friction surfaces formed and adapted, during normal use, to be in frictional contact with a wear resistant surface on the other of the side frame and bolster, said spaced friction surfaces being discontinuous over the entire area of contact.

2. The railroad car truck of claim 1 characterized in that the wedge body is formed and adapted to be positioned in a pocket in the bolster.

3. The railroad car truck of claim 1 characterized in that the distance between said generally parallel friction surfaces is generally equal to the width of at least one of said friction surfaces.

4. The railroad car truck of claim 1 characterized in that said friction surfaces have generally equal width.

5. The railroad car truck of claim 1 characterized in that said spaced generally parallel friction surfaces are located adjacent opposite sides of said wedge.

6. A railroad car truck including a pair of side frames and a bolster extending .therebetween, a friction wedge for use in damping relative movement between said bolster and one of said side frames, a pocket in facing portions of one of the bolster and side frames, said wedge including a body formed and adapted to be positioned in the pocket said body having friction surface means, formed and adapted during normal use, to be in frictional contact with a wear resistant surface on the other of said side frame and bolster, means for concentrating at least a portion of the load applied by the friction surface means to the wear resistant surface onto an area of the friction surface means furthest from the axis of side frame/bolster warp movement to thereby increase the resistance to side frame/bolster warp movement, said concentrating means including a recess in said friction surface means, intermediate the lateral sides of said wedge, which recess extends the full height of said wedge friction surface means and divides the area of contact between said friction surface means and said wear resistant surface into spaced inboard and outboard areas.

7. The railroad car truck of claim 6 characterized in that said recess is centrally located in said wedge friction surface means.

8. The railroad car truck of claim 7 characterized in that said recess provides frictional surface contact areas of generally equal width.

9. A railroad car truck damping system including a bolster having at least one bolster pocket with an interior slanted wall, a friction wedge positioned within said pocket, said wedge having spaced body portions integrally joined by an intermediate connecting portion, each of said body portions having a friction surface formed and adapted during normal use to be in frictional contact with a side frame, a space in said wedge between said body portions, and a retainer extending outwardly from said bolster pocket slanted wall into said wedge space for preventing lateral movement of said wedge relative to said bolster pocket.

10. The damping system of claim 9 characterized in that said wedge body portions each have slanted faces in contact with said bolster pocket slanted surface on opposite sides of said retainer.

* * * * *